United States Patent [19]

Gambino

[11] Patent Number: 4,765,555

[45] Date of Patent: Aug. 23, 1988

[54] ROLL PAPER DISPENSER

[76] Inventor: James J. Gambino, 136 Stanislaus St., Buffalo, N.Y. 14212

[21] Appl. No.: 74,970

[22] Filed: Jul. 17, 1987

[51] Int. Cl.[4] ..... B65H 19/10

[52] U.S. Cl. ..... 242/55.53; 312/39

[58] Field of Search ..... 242/55.2, 55.53, 55.3; 312/38, 39

[56] References Cited

U.S. PATENT DOCUMENTS 3,301,617 1/1967 Goodwin et al. ..... 312/39

4,666,099 5/1987 Hoffman et al. ..... 242/55.53

*Primary Examiner*—David Werner

*Attorney, Agent, or Firm*—James J. Ralabate

[57] ABSTRACT

A dispenser having simple and removably expendable components including two identical slotted brackets which support, an upper roller and a lower roller. The upper roller fits into the spool of the toilet tissue or paper towel and permits the spool to rotate thereupon. The lower roller is in contact with the power drive unit and is made movable thereby. The power drive unit or motor and drive means comprise a battery compartment, a motor in electrical connection with the batteries in the compartment, a gear in contact with the motor and a drive roller in contact with the gear. The drive roller is in physical contact with the lower roller and rotates the lower roller in a clockwise manner. The motor and drive unit are easily removed as a complete unit from the dispenser housing by loosening one or two screws that attach the unit to the frame of the housing. Thus, the present invention provides an easily detachable motor and drive unit with a reusable dispenser unit.

10 Claims, 4 Drawing Sheets

ROLL PAPER DISPENSER

This invention relates to a paper dispenser and, more particularly, to an automatic roll paper dispenser.

BACKGROUND OF THE INVENTION

There are known various devices for dispensing paper from containing housings or other structures. The present invention involves the use of a novel dispensing device for use with a roll of paper towels, a roll of toilet tissue, wax paper and other paper products that are sold on a spool or roll. While the product being dispensed will be referred to throughout this disclosure as "paper roll", it is to be understood that other materials such as aluminum foil, wax paper, rolls of polymeric materials and the like are intended to be included.

Devices of this type are used and some are disclosed in U.S. Pat. Nos. 3,297,269; 3,301,617; 3,760,976; 3,963,190 and 4,270,818.

In U.S. Pat. No. 3,297,269 an electric toilet paper dispenser is disclosed wherein thepower unit is permanently attached to the dispenser housing. It is important in devices of this type that the motor and drive means be easily detached from the dispenser so that it can be easily replaced if the motor burns out or the power unit somehow becomes inoperative. Today, very economical motor units are available for devices of this type such as the motors sold by Radio Shack and identified as Cat. No. 273-231. It is important when the dispenser becomes inoperative that only the power unit need be replaced rather than discarding the entire dispenser.

In U.S. Pat. No. 3,301,617 (Goodwin, et al.) a paper dispensing apparatus is disclosed whereby the power is generated by a motor which runs on 110/120 VAC. Devices of this type require major electrical work and because of their electrical requirements can be expensive to purchase and operate. In addition, the device of Goodwin locates the push button activator in the path of the toilet tissue being dispensed which could cause mechanical problems during use. In addition, the motor is a relatively expensive component of the dispenser and cannot be easily detached from the unit. Thus, when the motor becomes inoperative, the entire Goodwin device needs to be discarded.

In U.S. Pat. No. 3,760,976 which issued to Andreacchio, a cover for a toilet tissue unit is disclosed. While this device is easily replaced and relatively inexpensive, it does not provide for automatic dispensing of roll paper.

In U.S. Pat. No. 3,963,190 (Wilson) a tissue-dispensing device for a roll of tissue is disclosed wherein the roll is rotated by a cord disposed outside the device. When the user wants a desired amount of tissue, he or she pulls the cord and a set amount of tissue is dispensed. While this device is relatively inexpensive, it does not provide for automatic dispensing of roll paper.

In U.S. Pat. No. 4,270,818 (McCabe), a power winding paper towel dispenser is disclosed. This device is relatively complex and requires a comparatively expensive motor and battery to operate. The motor and battery compartment extend outside the device housing and power a spindle which winds used towel portions or spent toweling into a compartment. This type of device is only usable with paper or fabric towels and is relatively expensive to operate and purchase.

SUMMARY OF THE INVENTION

It is therefore an object of this invention to provide a paper roll dispenser device that is devoid of the above-noted disadvantages.

It is another object of this invention to provide a roll paper dispenser that has an expendable power supply unit.

Another object of this invention is to provide a paper roll dispenser device that is relatively inexpensive and simple to use.

A further object of this invention is to provide an efficient dispensing means that is easy to assemble and disassemble when parts need replacing.

A still further object of this invention is to provide a simple dispenser particularly suitable as a toilet tissue dispenser.

Another still further object of this invention is to provide a toilet tissue dispenser that may be used as a counter top dispenser or a dispenser for installation into a cavity in the wall.

These and other objects of this invention will become apparent and are accomplished in accordance with this invention by providing a novel dispenser having simple and removably expendable components. The dispenser has a housing preferably constructed of plastic or fiberglass and the like. On the inner portion of the side walls of the dispenser are located two (one on each side) slotted brackets which support two rollers, an upper roller and a lower roller. The brackets are identical and are positioned parallel to each other in order to properly hold the spindles or axles of each roller in a substantially horizontally level position. The upper roller fits into the spool of the toilet tissue or paper towel and permits the spool to rotate thereupon. The lower roller is in contact with the power drive unit and is made movable thereby. The power drive unit or motor and drive means comprise a battery compartment, a motor in electrical connection with the batteries in the compartment, a gear in contact with the motor and a drive roller in contact with the gear. The drive roller is in physical contact with the lower roller and rotates the lower roller in a clockwise manner. The paper from the paper roll extends downward from the paper roll between the drive roller and lower roller and is dispensed through a slot in the housing to the outside of the dispenser. The motor used is an expendable 1.5 volt D.C. motor such as Radio Shack motor Cat. No. 273-231, costing approximately 0.50. The motor and drive unit are easily removed as a complete unit from the dispenser housing by loosening one or two screws that attach the unit to the frame of the housing. Since inexpensive motors such as those used in the present invention have not been available until recently, it was not possible to provide a dispenser such as the one described herein wherein only the motor needs to be discarded and replaced once the unit becomes inoperative. Thus, the present invention provides an easily detachable motor and drive unit with a reusable dispenser unit.

DESCRIPTION OF DRAWING AND PREFERRED EMBODIMENT

Figure 1:
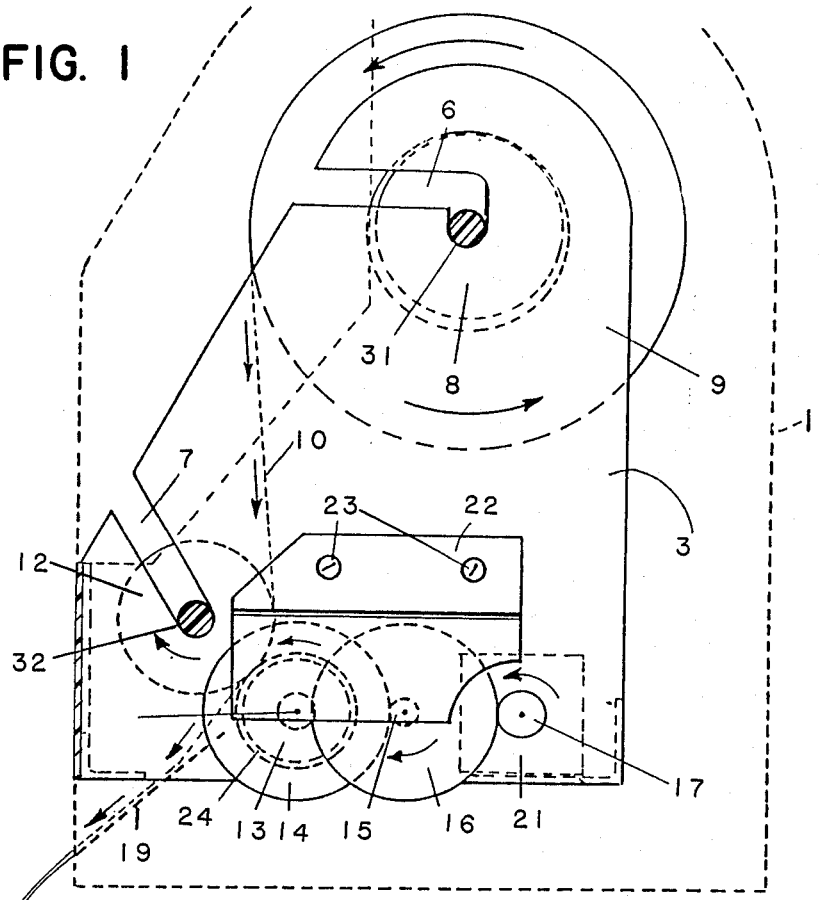
FIG. 1 is a vertical sectional side view of the dispenser of this invention.

In FIG. 1, dispenser housing 1 is constructed preferably of a suitably insulating material such as plastic or fiberglass. While a metal can be used it is preferred for durability and insulation that an electrically inert material be used. Side wall 2 has attached to its inner face a bracket 3 and the opposite side wall 4 has attached to its inner face an identical bracket 5. Each bracket 3 and 5 has identical slots 6 at its upper portion and lower slots 7 at its bottom portion. Upper slots 6 are substantially L-shaped and have upper roller means 8 rotary mounted therein. A roll of toilet tissue or other paper roll 9 is slid over upper roller means 8 and is adapted to roll on said upper roller means 8 when a pulling pressure is exerted upon the continuous paper sheet 10 that extends from said paper roll 9. In the lower slot means 7 a second or lower roller 12 is rotably supported. Lower roller 12 is rotated or activated by the turning action of drive roller 13 which is in peripheral contact therewith. A gear 14 provides impetus to drive roller 13 by its mechanical contact with small gear 15. A plate gear 16 is turned by motor gear 17 once the motor 21 is activated. Continuous paper sheet 10 extends downwardly from paper roll 9 between the nip 18 of lower roller 12 and drive roller 13, and from there to a paper guide 19 which guides the paper out guide slot 20. Holding the entire motor and drive unit (i.e. motor 21, drive roller 13, gears 14, 15 and plate gear 16) is a bracket 22 which is attached to the side 2 by a single or double securing means or screw 23. By loosening this screw 23 the entire motor and drive unit can be removed and any of the components such as the motor, gears etc. replaced. Around drive roller 13 are a plurality of "0" rubber rings 24 which provide substantial frictionless momentum to the paper. The rubber rings 24 grip the paper 10 firmly and minimize premature tearing during the dispensing operation. Roller 8 during the operation turns in a counterclockwise motion while lower roller 12 turns in a clockwise motion. Slots 6 and 7 permit easy removal of rollers 8 and 12 therefrom. The motor and drive means unit comprises motor 21, drive roller 13 and gears 14, 15 and 16. Spindles 31 and 32 fit into grooves 6 and 7 respectively and rotably support the upper and lower rollers 8 and 12. This invention provides a removable unit of all of the most consumable components which was heretofore unavailable in prior art dispensers. This removable unit provides for increased useful life of the dispenser and reduces significantly the cost of maintenance.

Figure 2:
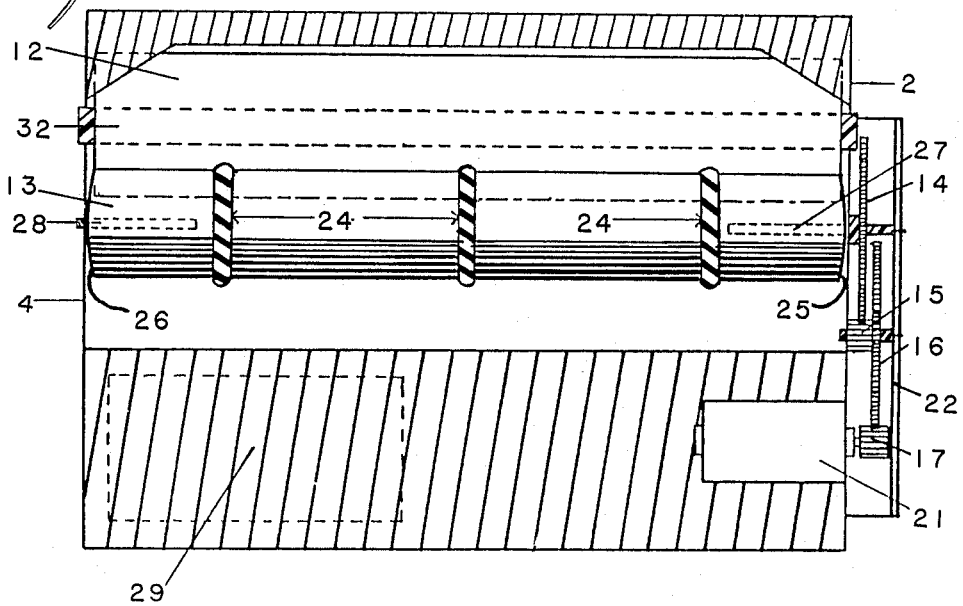
FIG. 2 is a bottom sectional view of the removable motor and drive unit of this invention.
Figure 5:
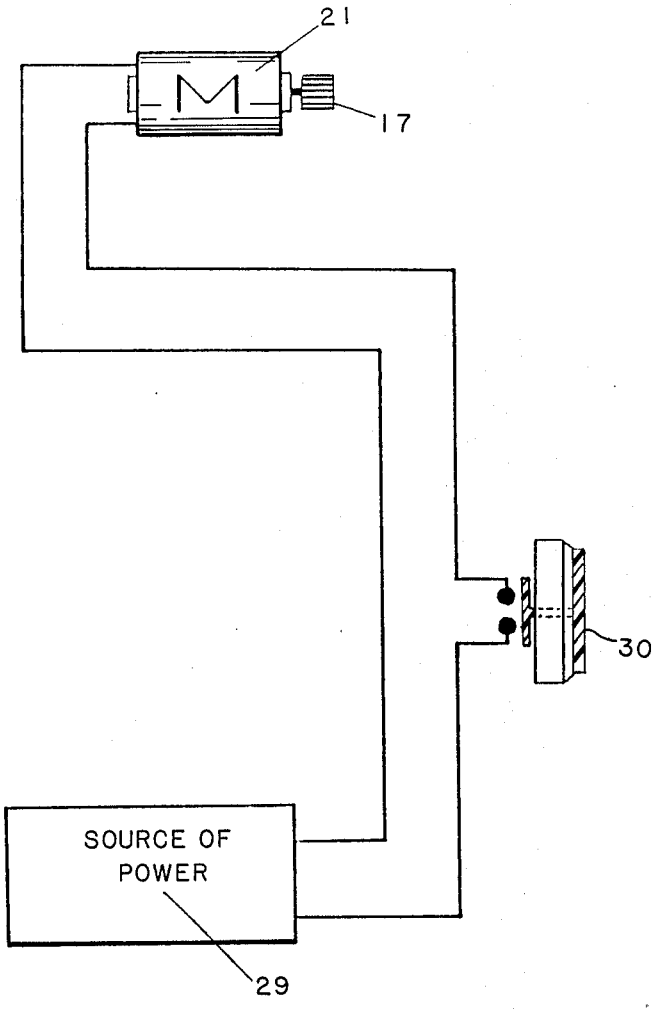
FIG. 5 is a diagram of the electrical system of the present invention.

In FIG. 2 the removable motor and drive means of this invention is shown. Drive roller 13 has around its circumference at least one rubber ring 24 to grip the paper and project it downward and out of dispenser housing 1 when in use. Drive roller 13 is fixed at one terminal portion 25 to a large drive gear 14 which in turn meshes with smaller gear 15. Smaller gear 15 is meshed with motor gear 17 which provides the impetus for the entire removable motor and drive unit. The motor 21 is a relatively inexpensive and disposable motor which can economically be replaced rather than the entire dispenser once the dispenser becomes inoperative. This D.C. motor is powered by two AAA batteries which are housed in a compartment 29 adjacent motor 21, or in electrical connection therewith as shown in FIG. 5. At both the terminal end portions 25 and 26 of drive roller 13 are small diameter shafts 27 and 28 which function as support for drive roller 13 and ensures even rotation thereof. All rollers in this device can be mode of wood, rubber, metal, plastic or other suitable materials. The gear arrangement provides the drive roller 13 the torque it needs to dispense the paper to guide 19 through guide slot 31 and out of the dispenser 1.

Figure 3:
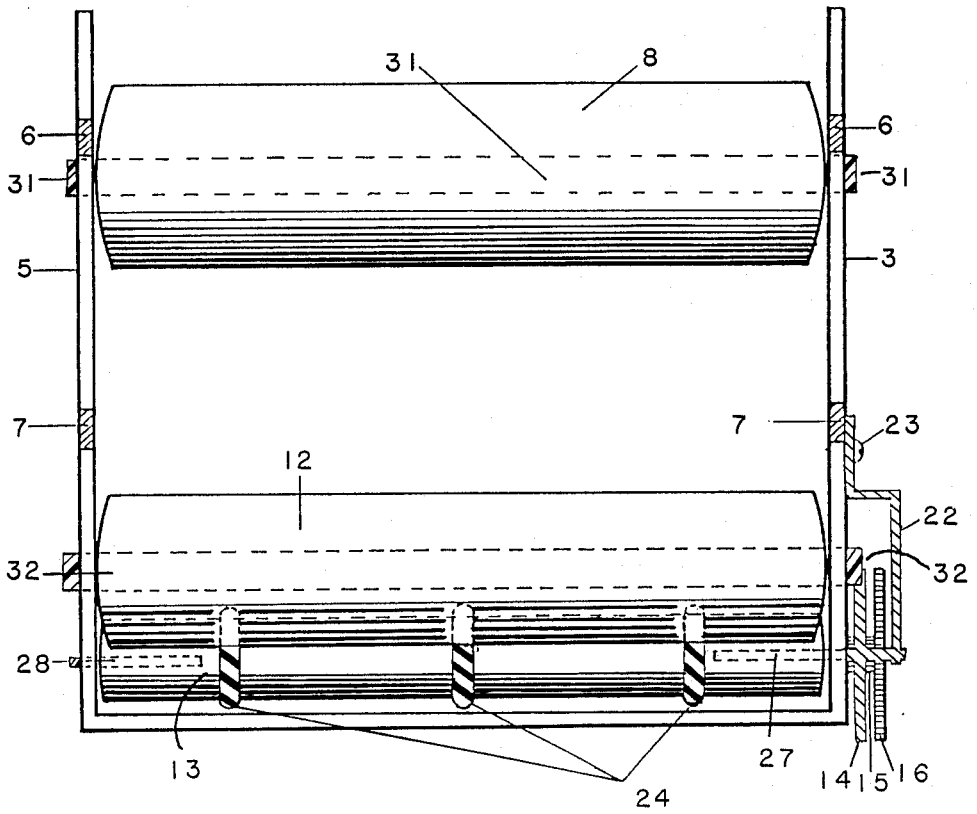
FIG. 3 is a front sectional view of the dispenser of this invention.

In FIG. 3 a top view of inner portion of dispenser 1 is shown wherein upper roller 8 is rotably mounted in slot 6. Spindle 31 of roller 8 fits in slot 6 and rotates therein when a pulling action is exerted upon sheet 10 which extends downwardly therefrom as shown in FIG. 1. Likewise, spindle 32 of lower roller 12 is rotably mounted in slot 7 and is adapted to turn in a clockwise motion when moved by the motor and drive means. Bracket connector. 32 connects brackets 3 and 5 at right angles and maintains the structure as an integral unit.

Figure 4A:
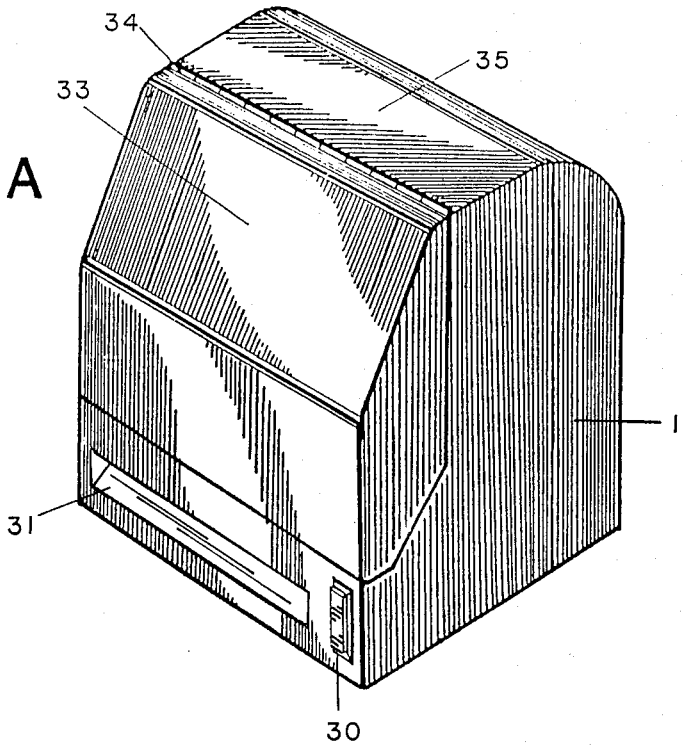
FIG. 4A is a perspective view of the dispenser of the present invention.
Figure 4B:
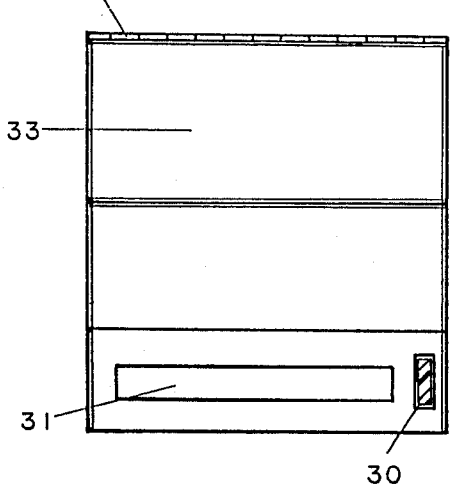
FIG. 4B is a front plan view.
Figure 4C:
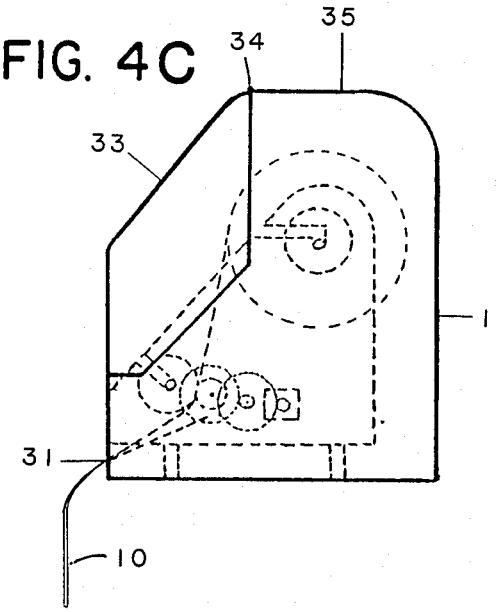
FIG. 4C is a side sectional view of the dispenser of this invention.

In FIGS. 4A, 4B and 4C, the dispenser with the closed housing 1 is shown in perspective. In the front portion of housing 1 is lid section 33 having a hinge 34 which connects it to the top portion 35 of housing 1. Lid section 33 is merely lifted to resupply a paper roll to the dispenser. Lid section 33 is also lifted to remove the motor and drive unit of this invention. Alternately, securing means 23 may extend outside housing 1 for easy removal of the motor and drive unit as one piece. Exit slot 31 is provided at the bottom portion of the dispenser for exiting of the paper sheet. The motor and drive means are activated by pushing button 30 which closes the circuit and dispenses paper through exit slot 31.

In FIG. 5, the electrical diagram is shown with motor 21 electrically driven by two AAA size batteries located in compartment 29 at the bottom of the removable chasis as illustrated in FIG. 2. The electric motor 21 is connected to the source of power 29 and a normally open switch 30 which when depressed completes and connects the circuit between the motor 21 and the source of power 29.

The DC motor used is very inexpensive (about 0.50) and obtained from Radio Shack, cat. no. 273-231. Since all of the components are easily removed and replaced, the dispenser now can be used indefinitely rather than the comparable low life of prior art devices once the motor has become inoperable.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A roll paper dispenser comprising a dispenser housing, two removable side brackets, drive means, and two roller means, said dispenser adapted to dispense any desired amount of paper, said side brackets disposed in parallel relationship to each other and positioned in upright vertical positions on inner part of side walls of said dispenser housing, said brackets movably supporting said roller means, said roller means comprising an upper roller and a lower roller, said upper roller is rotably mounted on said brackets and adapted to accommodate a paper roll, said lower roller in contact with said drive means and adapted to be rotated thereby, said lower roller also adapted to receive and move paper from said paper roll to a location outside said roll paper dispenser, said drive means comprising as an integral unit a motor, a drive roller, and drive gears, said drive means being structured to be removed as a complete unit from said dispenser housing.

2. The dispenser of claim 1 wherein said motor and drive means is attached to said housing by a securing means accessible from outside said housing.

3. The dispenser of claim 1 wherein said motor and drive means is adapted to be powered by conventional flashlight batteries.

4. The dispenser of claim 1 wherein said motor is a D.C. motor powered by conventional flashlight batteries.

5. The dispenser of claim 1 wherein said brackets have upper and lower slots into which said rollers are movably supported, said upper slot supporting said upper roller and allowing said roller to rotate therein, said upper roller extending through the roll of said roll paper and permitting said roll to rotate thereon, said roll paper adapted to be rotated by a pull of said paper by said lower roller which is in contact therewith.

6. The dispenser of claim 1 wherein an activating means is located externally of said housing, said activating means adapted to move said lower roller to thereby dispense paper from said paper roll.

7. A roll paper dispenser comprising a dispenser housing, two parallel disposed removable brackets located on the inner sides of said housing, roller means and a motor and drive means, said brackets fixed to the sides of said housing and having identical upper and lower slots therein, said slots adapted to hold the axle of a roller and movably support said roller, said roller means comprising an upper and a lower roller, said upper roller movably positioned in said upper slot and becoming continuously rotatable upon a pulling action of paper connecting it with said lower roller, said lower roller adapted to be moved by said motor and drive means upon activation of said motor and drive means and adapted to dispense any amount of paper depending upon the duration of its activation, said motor and drive means comprising a motor, a battery compartment, a gear connected to said motor and a drive roller, said drive roller in contact with said lower roller to thereby rotate said lower roller, said lower roller adapted upon rotation to move and continuously dispense paper from said dispenser housing, said motor and drive means being structured to be removed as an integral unit from said dispenser housing.

8. The dispenser of claim 7 wherein said motor and drive means is attached to said housing by a securing means accessible from outside said housing.

9. The dispenser of claim 7 wherein said motor and drive means is adapted to be powered by conventional flashlight batteries.

10. The dispenser of claim 7 wherein an activating means is located externally of said housing, said activating means adapted to move said lower roller to thereby dispense paper from said paper roll.

* * * * *